US006374741B1

(12) United States Patent
Stanley et al.

(10) Patent No.: US 6,374,741 B1
(45) Date of Patent: Apr. 23, 2002

(54) NON-LETHAL PROJECTILE TO BE LAUNCHED FROM A LAUNCHER

(75) Inventors: Michael Stanley, Socorro; John Osowski, Belen; Jerome Lattery, Socorro, all of NM (US)

(73) Assignee: New Mexico Tech Research Foundation, Socorro, NM (US)

( * ) Notice: Subject to any disclaimer, the term of this patent is extended or adjusted under 35 U.S.C. 154(b) by 0 days.

(21) Appl. No.: 09/519,021

(22) Filed: Mar. 3, 2000

(51) Int. Cl.[7] ..... F42B 30/00
(52) U.S. Cl. ..... 102/439
(58) Field of Search ..... 102/502, 439, 102/438, 393, 394, 434

(56) References Cited

U.S. PATENT DOCUMENTS 3,952,658 A * 4/1976 Broyles ..... 102/438
4,724,766 A * 2/1988 LaBuddle ..... 102/393
4,793,260 A * 12/1988 Kruse et al. ..... 102/489
4,869,174 A * 9/1989 Hanser et al. ..... 102/489
5,076,171 A * 12/1991 Altenau et al. ..... 102/489

* cited by examiner

*Primary Examiner*—Charles T. Jordan
*Assistant Examiner*—Jordan Lofdahl
(74) *Attorney, Agent, or Firm*—R W Becker & Associates; R W Becker

(57) ABSTRACT

A non-lethal projectile and a method of igniting the same are provided. A propulsion charge acts on a base portion of a casing of the projectile and is ignitible from a launcher for launching the projectile therefrom. An initiator is disposed in the casing, with a combination timing and firing mechanism that is also disposed in the casing initiating the initiator. A dispersal charge is disposed in the casing and is ignitable by the initiator. Such dispersal charge is electronic subsequent to launching the projecting and prior to the projectile reaching a target area.

16 Claims, 4 Drawing Sheets

NON-LETHAL PROJECTILE TO BE LAUNCHED FROM A LAUNCHER

BACKGROUND OF THE INVENTION

The present invention relates to a non-lethal projectile that is to be launched from a launcher, and also relates to a method of igniting such a projectile.

Police officers and military personnel involved in peace keeping efforts often need an effective non-lethal means for subduing a person or persons from a safe distance. With devices and methods presently known, a user is required to either hit a target directly with a ballistic, or to rely on inaccurate hand-thrown or launched area-of-effect weapons.

It is an object of the present invention to provide a non-lethal projectile that can be delivered with an aim-point device to subdue a person from a safe distance.

BRIEF DESCRIPTION OF THE DRAWINGS

This object, and other objects in advantages of the present invention, will appear more clearly from the following specification in conjunction with the accompanying schematic drawings, in which.

SUMMARY OF THE INVENTION

The non-lethal projectile of the present invention includes a casing, a propulsion charge that acts on the base portion of the casing and is ignitible from a launcher for launching the projectile therefrom, and initiator disposed in the casing, a combination timing and firing means disposed in the casing for initiating the initiator, and a dispersal charge disposed in the casing and ignitible by the initiator. Such a projectile is also known as a so-called semi-smart projectile.

Pursuant to the method of the present invention, after the projectile has been launched and prior to the time that the projectile reaches a target area, a dispersal charge in the projectile is electronically ignited. Further specific features of the present invention will be described in detail subsequently.

DESCRIPTION OF PREFERRED EMBODIMENTS

Figure 1:
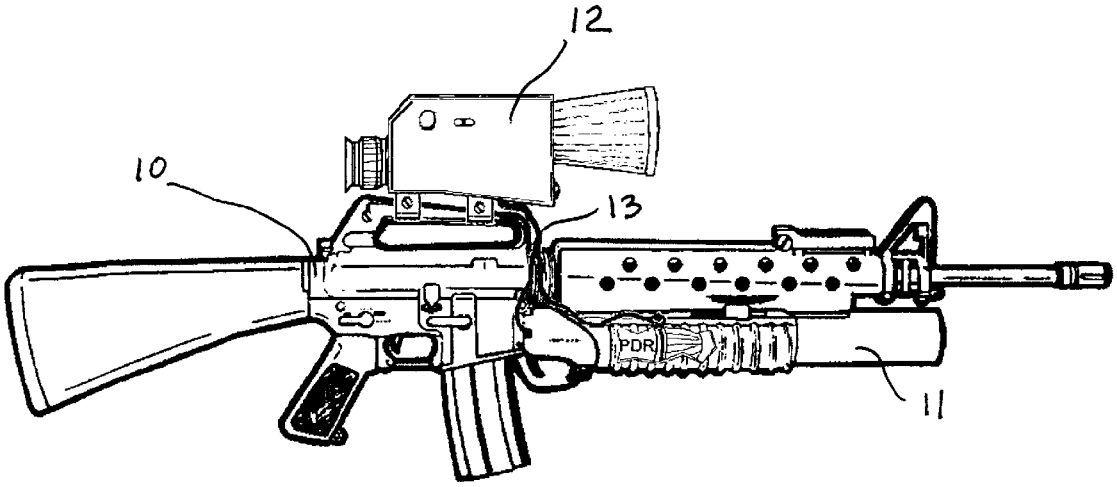
FIG. 1. illustrates a firearm with an aiming device and a launcher for delivering the non-lethal projectile of the present invention.

Referring now to the drawings in detail, FIG. 1 illustrates by way of example only a firearm 10 that is provided with a launcher 11, for example a 40 mm launcher, that is utilized to launch the non-lethal projectile of the present invention, which will be described in detail subsequently. It is to be understood that the launcher 11 could also be a self-contained launcher. At any rate, an aiming device 12 is provided on the firearm 10. The aiming device 12, which contains a non-illustrated power pack, communicates with the launcher 11 via a cable 13.

Figure 2:
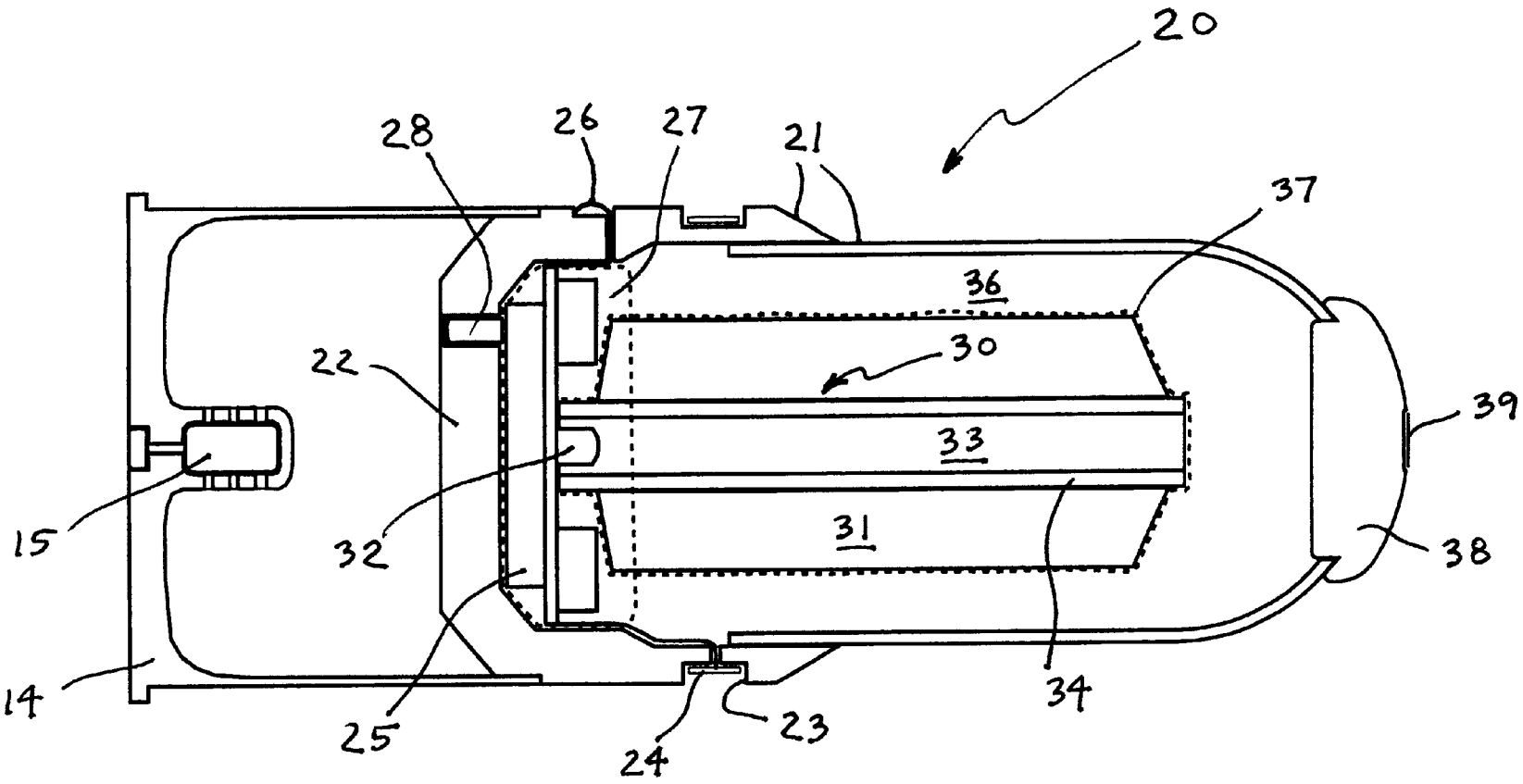
FIG. 2 illustrates one exemplary embodiment of the projectile of the present invention.

FIG. 2. illustrates one exemplary embodiment of the inventive non-lethal projectile, which is indicated generally by the reference numeral 20 and is disposed in a standard case or firing cartridge 14 for placement in the launcher 11, which can be embodied similar to a grenade launcher. A propulsion charge 15 is provided in the firing cartridge 14 and is designed to be fired by, for example, a percussion pin of the firearm 10 for launching the projectile 20 from the launcher 11. The propulsion charge 15 can be a standard propulsion charge, such as combustible propellant, or could, for example, also be a blank or compressed gas.

The projectile 20 includes a casing 21, which can be a one part or two part casing, and is made of a material that is capable of withstanding the shock of being fired from the launcher 11. For example, the casing 21 can be made of a suitable polymeric material such as polyethylene, metal such as brass, and even paper. If the casing 21 is made of two parts, each part can be made of a different material. The propulsion charge 15 in the firing cartridge 14 acts upon the base portion 22 of the projectile casing 21 to propel or launch the projectile 20 out of the launcher 11.

A recess 23 is provided in the projectile casing 21 for receiving an electrical contact band 24 that, in a manner to be described in detail subsequently, is connected via a portion of the launcher 11 to the cable 13 and hence to the aiming device 12 for receiving positive voltage and range and timing signals for the electronics package 25 that is disposed in the base portion 22 of the casing 21. A ground contact 26 for the electronics package 25 is also provided on the casing 21.

The electronics package 25, which is a combination timing and firing mechanism and includes a microcontroller, is responsible for igniting the projectile 20 at a pre-programmed time after launch. The electronics package 25 is potted into the base portion 22 by means of a potting material 27, such as silica, elastic polymer, or the like, so that the electronics package 25 can survive the launch acceleration of the projectile 20. Although illustrated as being disposed in the base portion 22, it is to be understood that the electronics package 25 could also be provided in another location, for example on a narrow board disposed in the central core of the projectile 20.

In the illustrated embodiment, a launch detector 28, such as a launch detection transducer, extends from the electronics package 25. The launch detector 28 detects launch of the projectile 20, for example by means of sensing base pressure on the projectile or by sensing sustained acceleration that is indicative of launch.

Disposed on that side of the electronics package 25 that is remote from the propulsion charge 15 is an initiator 30 for initiating a dispersal charge 31 of the projectile 20. The initiator 30 is initiated by the timing and firing mechanism of the electronics package 25.

The initiator 30 includes a primer 32 that is activated by the electronics package 25 and in turn activates a propellant 33, especially a fast burning propellant, which can, for example, be smokeless powder. The propellant 33 is in the form of a center core ignitor that is disposed in a frangible tube 34, which can be made, for example, of paper, thin plastic, wax paper, or the like. The dispersal charge 31 is then disposed about the frangible tube 34. Such dispersal charge, which is also known as a pyrotechnic charge or flash-bang charge, and is intended as a sensory disruptive mechanism, can be a mixture of aluminum and magnesium powder or potassium chloride, and can also include micro pulverized agents, pepper, dyes and the like. The burning of the dispersal charge 31 causes a great increase in pressure within the projectile 20 and causes the casing 21 thereof to rupture and to cause a filler 36 that can be disposed about the dispersal charge 31 to be dispersed into the atmosphere. The filler 36 comprises non-lethal material, such as chemical irritant, oleo-resin capsicum, tear gas, mace, pepper, etc., or mixtures thereof, and can also be in the form of a fog or mist. The filler 36 can be in the form of micro balloons of glass or plastic that are filled with the chemical irritant or the like. Such micro balloons are then crushed by the burning of the dispersal charge 31, allowing the contents of the micro balloons to be dispersed into the atmosphere. A moisture-proof barrier 37 may be disposed about the dispersal charge 31 between the latter and the filler 36. Such moisture-proof barrier 37 can be made of any suitable material, such as polymeric material, wax or the like.

The casing 21 of the projectile 20 may also be provided with a separate nose 38, which is made of either hard or soft material depending upon the intended application of the projectile 20. For outside applications, the nose 38 can, for example, be made of soft rubber or a suitably soft polymeric material. The nose 38 can also be provided with an optional impact switch 39 that will disable the projectile 20 if it has failed to ignite prior to impact. Further details concerning this operation will be discussed subsequently. If, on the other hand, the projectile 20 is intended to penetrate a barrier such as a window or wall, the nose 38 can be made of a material such as aluminum or titanium. It is to be understood that for such an application where the projectile 20 is intended to penetrate a barrier no impact switch 39 would be provided.

Figure 3:
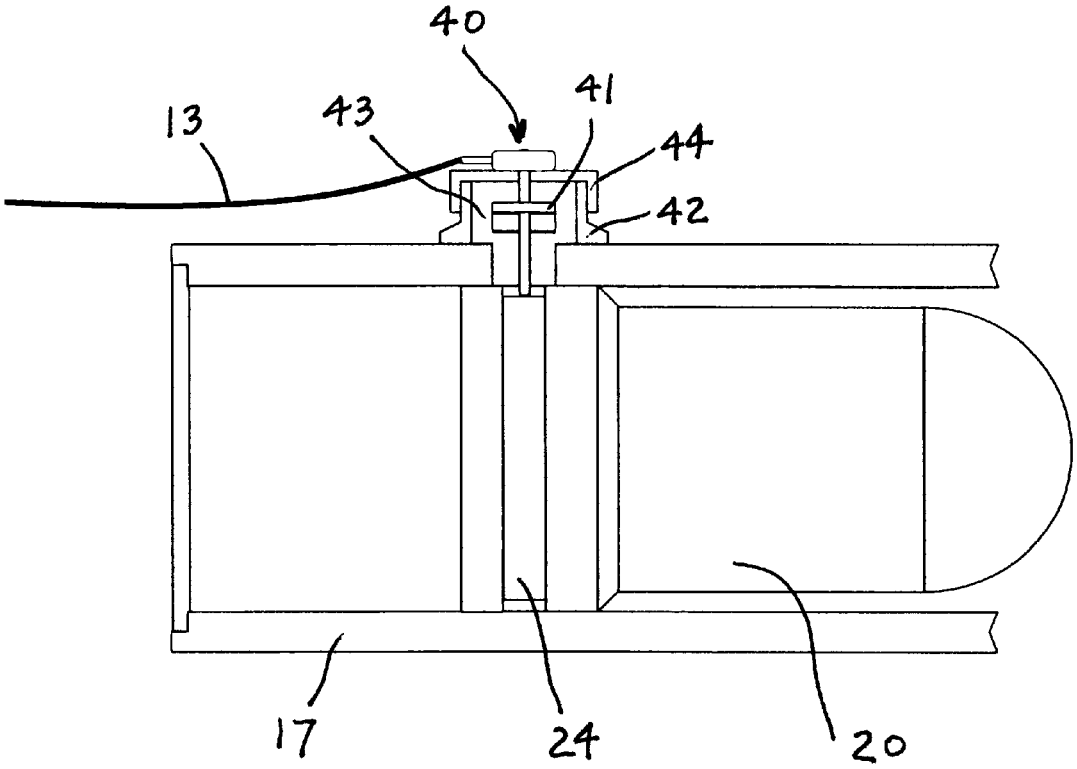
FIG. 3 illustrates one exemplary embodiment of means for providing electrical contact between an aiming device and a projectile loaded into a launcher.

As indicated previously, the electronics package 25 receives power from the aiming device 12 via the cable 13. Pursuant to one specific embodiment of the present invention, power can be transferred to the projectile 20, and hence to the electronics package 25 thereof, in the manner illustrated in FIG. 3. In particular, FIG. 3 illustrates a retractable pin assembly 40 that is connected to the cable 13. The pin assembly 40 is seated on a part 17 of the launcher 11 in which the projectile 20 is disposed. The pin assembly 40 includes a conductive transmission pin 41 that passes through an insulator 42 mounted on the part 17. The transmission pin 41 applies positive pressure to the electrical contact band 24 of the projectile casing 21 by means of an elastic insulator 43. The entire pin assembly 40 is fixed to the part or barrel 17 of the launcher 11 via a metal housing 44. It is to be understood that alternative electrical transmission means could also be provided in place of the illustrated retractable pin assembly 40. For example, in order to provide electrical contact with the contact band 24 of the projectile casing 21, an annular or concentric ring could be provided in the barrel part 17 of the launcher 11, or an inductive transmission mechanism could be provided.

Figure 4:
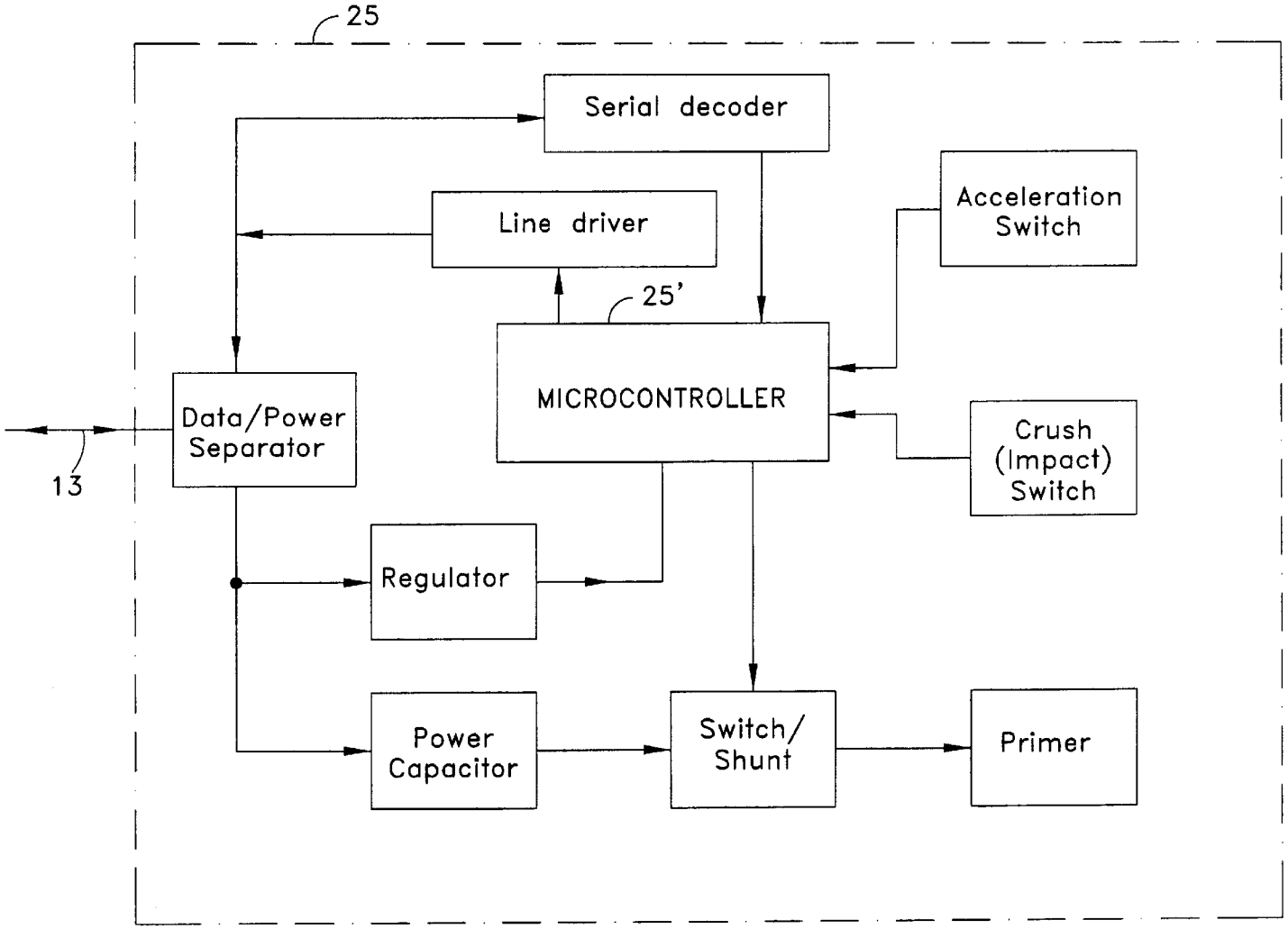
FIG. 4 illustrates one exemplary embodiment of the electronics package of the projectile of the present invention.

Operation of the electronic system for the present invention will now be described in conjunction with FIG. 4, which in particular illustrates one specific embodiment of the electronics package 25, of the projectile 20.

The electronics package of the projectile 20 is built around a miniature microcontroller 25', such as Microchip PIC 16C505. Actions of the microcontroller are performed through its port connections as a result of the programming placed in the memory of the microcontroller. The main functions of the microcontroller 25' are to control the time to burst, to sense acceleration (i.e. launch), unchambering, impact, and to switch electrical energy through the primer 32 to fire the projectile 20. The microcontroller 25' also performs two-way electrical energy signal communication with the aiming device 12. Communication received from the aiming device is a digital number used to create the time interval after which the projectile 20 is to be initiated in flight. Communication back from the projectile to the aiming device digitally conveys an identifying code used to describe essential characteristics of the projectile.

An important and novel characteristic of the communication between the projectile 20 and the aiming device 12 is that it reveals indirectly the clock rate of the microcontroller 25' in the projectile. It is envisioned that for economical production of the projectile the clock speed be controlled by a simple resistor-capacitor network, rather than by a precision timing element such as a quartz crystal, although the latter is of course possible. Further, it is desirable to not require accurate calibration of the clock due to the expense of doing so and the possibility of changes in properties of the timing components with age that could decalibrate the clock. The clock in the projectile 20 is envisioned as having a timing error as great as twenty-five percent above or below the designed nominal value as a result of initial component tolerance and aging. However, proper functioning of the projectile requires fuse timing accuracy within approximately one-tenth of one percent during flight. The desired accuracy is therefore attained by determining the actual clock rate of the microcontroller 25' in the projectile 20 and correcting the count contained in the command message to produce the desired initiation time.

The speed of the clock in the projectile 20 is measured by determining the time duration of the response signal from the projectile. This is accomplished by a microprocessor in the aiming device 12. The microprocessor has a timer that can be programmed to accurately measure the duration of the response signal from the projectile 20, which is directly proportional to the speed of the clock in the projectile. Having determined the clock speed of the projectile, the microprocessor of the aiming device 12 is programmed to calculate the number of clock cycles required in the projectile to produce the correct fusing time at the measured clock speed. This number is conveyed from the aiming device 12 to the projectile 20 in the command signal. The process of measuring the clock speed of the projectile is repeated during each exchange of signals between the aiming device and the projectile, which occurs approximately twenty times per second.

When the projectile 20 is chambered or loaded in the launcher 11, a DC voltage of from 24 to 200 volts is present on cable 13. In addition to the DC voltage, serial digital signals from the aiming device 12 to the projectile 20 and return signals from the projectile are present on the cable. The data/power separator (see FIG. 4) allows DC power to pass to the regulator and the power capacitor while blocking the DC power from passing to the serial digital elements, which are the serial decoder and the line driver. The serial digital signals are a form of AC current, and are blocked from being absorbed by the regulator and the power capacitor by the data/power separator. The electrical circuit return for the power and the serial digital signals is through the conductive case of the projectile 20. Later, after launch, no power or connection is available from the aiming device 12, so operating current for the microcontroller 25' will be supplied from the power capacitor.

Prior to launch or removal from the aiming device 12, the projectile 20 and the aiming device maintain communication. The command signal from the aiming device is sent to the projectile approximately 20 times per second. The microcontroller 25' in the projectile 20 creates a response each time a signal is received from the aiming device 12. The command signal information to the projectile is the number of clock cycles to be counted down after launch to determine the time to initiate the primer 32. The command signal is sent several times per second to continually adjust the initiation time in response to measured range and other conditions at the aiming device 12.

Each time the projectile 20 has received a command signal it will send a response signal back to the aiming device. The response signal is a serial binary word that encodes a number (i.e. an identification code) that describes the characteristics of the projectile. It is envisioned that several styles of projectile could be made with differing properties, such as weight and propellant strength, that would influence the flight trajectory. The response signal informs the aiming device 12 of the particular style of projectile present, so that the appropriate tables will be used to calculate the trajectory and initiation time. The microcontroller 25 in the projectile 20 sends the signal through the line driver that amplifies the power of the signal.

The serial digital command signal is a sequential group of electrical symbols consisting of a start symbol followed by a predetermined number of self clocking binary symbols that, when decoded, form a binary number. The self clocking form of symbol described here is intended to provide reliable serial information transfer to the projectile 20 despite poor timing accuracy of the decoder in the projectile. The self clocking binary format has two electrical pulses for each binary symbol. The first pulse is negative with respect to the idle state, and signals the start of the symbol. The second pulse may have three different values or states, and determines the meaning of the symbol being sent. If the second pulse is negative with respect to the idle state, the symbol has no binary value itself, but does signify that the next symbol will be the first of a subsequent group. If the second pulse is positive with respect to the idle state, the binary character is a one. If the second pulse is zero with respect to the idle state, the binary character is a zero. A sixteen bit serial digital command would require a sequence of seventeen symbols. These would be the start symbol followed by sixteen symbols for the binary data characters.

The command signal is interpreted one symbol at a time, as each is received at the projectile 20 through the serial decoder, with the result accumulated in a data memory register in the microcontroller 25'. When the predetermined number of symbols have been received, as counted by the microcontroller programming, the command signal is completed and the number is considered valid. Later, commencing with launching of the projectile, the microcontrollerwill decrement the number at its clock rate. When the decremented number attains zero, the microcontroller 25' will produce a signal to initiate the burst. The signal opens the shunt element of the Switch/shunt and closes the series element. This causes the power capacitor to discharge through the primer 32 to initiate burst of the propellant 33 in the frangible tube 34 of the projectile 20.

When power is first applied to the system, or if power should be removed from the system without there being a launch, the shunt switch element is closed and discharges the capacitor. When the microcontroller is operating under program control, the shunt is opened, allowing the capacitor to charge.

When the projectile is launched, the motion is detected by closure of the acceleration switch, which is part of the launch detector 28. This provides a signal to the microcontroller 25'that launch has occurred and that counting down to the initiation time is to begin. If the projectile 20 is unloaded from the launcher 11 without being launched, the microcontroller 25' senses the break of the power connection combined with the lack of closure of the acceleration switch and closes the shunt of the switch/shunt to discharge the power capacitor without firing the primer 32.

If the projectile 20 is in flight and encounters an unintended object, the crush or impact switch 39 will be closed by the impact and signal the microcontroller 25'. The microcontroller would then close the shunt of the switch/shunt to discharge the power capacitor without firing the primer 32.

If the projectile 20 is removed from the launcher 11, or if it fails to initiate in flight, the power capacitor will discharge by the gradual consumption of its stored energy by idle operation of the microcontroller 25'. Within approximately seven seconds, the power capacitor will be so discharged that insufficient energy remains to initiate the primer 32. The projectile 20 would then become safe for recovery and disposal.

The present invention is, of course, in no way restricted to the specific disclosure of the specification and drawings, but also encompasses any modifications within the scope of the appended claims.

What we claim is:

1. A non-lethal projectile to be launched from a launcher, comprising:

a casing;

a propulsion charge acting on a base portion of said casing and ignitable from a launcher for launching of said projectile therefrom;

an initiator disposed in said casing, wherein said initiator comprises a primer, a frangible tube disposed about said primer, and a fast burning propellant disposed in said tube and ignitable by said primer;

a combination timing and firing means disposed in said casing for initiating said initiator; and a dispersal charge disposed in said casing and ignitable by said initiator.

2. A projectile according to claim 1, which includes a filler disposed about said dispersal charge, wherein said filler comprises a chemical irritant, fog or mist, or mixtures thereof.

3. A projectile according to claim 2, wherein said filler is in the form of micro balloons of glass or plastic filled with chemical irritant.

4. A projectile according to claim 1, wherein a moisture-proof barrier is disposed about said dispersal charge.

5. A projectile according to claim 1, wherein said timing and firing means includes a microcontroller that is preprogrammed or programmable to initiate said initiator as a function of time subsequent to launching of said projectile.

6. A projectile according to claim 5, wherein said microcontroller is provided with means for receiving signals from an aiming device associated with said launcher for adjusting a time of initiation of said initiator.

7. A projectile according to claim 6, wherein said microcontroller is provided with means for transmitting clock information back to said aiming device.

8. A projectile according to claim 5, wherein said casing is provided with an impact switch that is connected to said microcontroller, which includes shunt means for diverting power from said initiator if said impact switch is activated.

9. A projectile according to claim 1, wherein an electrical contact band is disposed about a portion of said casing for receiving power from an aiming device, and wherein said contact band communicates with said timing and firing means.

10. A projectile according to claim 9, which includes a retractable pin for establishing electrical contact between said aiming device and said electrical contact band of said casing of said projectile.

11. A projectile according to claim 1, wherein potting material is disposed in said base portion of said casing and surrounds said timing and firing means for protecting the latter during launch.

12. A projectile according to claim 1, which includes a launch detector disposed in said base portion of said casing on a side of said timing and firing means that is opposite said initiator, wherein said launch detector communicates with said timing and firing means for initiating countdown toward initiation of said initiator.

13. A projectile according to claim 1, which includes a separate nose portion on said casing opposite said base portion thereof, wherein said nose portion is made of hard or soft material.

14. A projectile according to claim 1, wherein said casing comprises two parts, each of which is made of different material.

15. A projectile according to claim 13, which includes an impact switch on said nose portion of said case, wherein said impact switch communicates with said timing and firing means for disabling the same.

16. A projectile according to claim 1, wherein said timing and firing means is chargeable externally via said launcher, and includes means for discharging said timing and firing means.

* * * * *